US010920762B2

(12) United States Patent
Kolpe

(10) Patent No.: US 10,920,762 B2
(45) Date of Patent: Feb. 16, 2021

(54) CYLINDER HEAD ASSEMBLY FOR A RECIPROCATING COMPRESSOR INCLUDING A CYLINDER HEAD WITH AN INTEGRAL VALVE PLATE

(71) Applicant: Emerson Climate Technologies, Inc., Sidney, OH (US)

(72) Inventor: Janardhan Sakhahari Kolpe, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 232 days.

(21) Appl. No.: 15/583,424

(22) Filed: May 1, 2017

(65) Prior Publication Data

US 2017/0321678 A1 Nov. 9, 2017

(30) Foreign Application Priority Data

May 7, 2016 (IN) ..... 201621016024
Oct. 11, 2016 (IN) ..... 201624034755

(51) Int. Cl.
*F04B 39/10* (2006.01)
*F04B 27/00* (2006.01)
(Continued)

(52) U.S. Cl.
CPC ..... *F04B 39/1066* (2013.01); *F04B 27/00* (2013.01); *F04B 27/0451* (2013.01);
(Continued)

(58) Field of Classification Search
USPC ..... 137/543, 543.13–23; 417/567, 570
See application file for complete search history.

(56) References Cited

U.S. PATENT DOCUMENTS 737,809 A * 9/1903 Whitaker ..... A47K 5/1204 417/558
758,183 A * 4/1904 Kryszat ..... A47K 5/1204 417/558
(Continued)

FOREIGN PATENT DOCUMENTS

CN 203822587 U 9/2014
CN 104179656 A 12/2014
(Continued)

OTHER PUBLICATIONS

First Office Action and Search Report regarding Chinese Patent Application No. CN201710318356.3, dated Aug. 27, 2018. Translation provided by Unitalen Attorneys at Law.
(Continued)

*Primary Examiner* — Peter J Bertheaud
*Assistant Examiner* — Geoffrey S Lee
(74) *Attorney, Agent, or Firm* — Harness, Dickey & Pierce, P.L.C.

(57) ABSTRACT

A cylinder head assembly for a compressor according to the present disclosure includes a valve plate and a cylinder head. The valve plate is configured to mount to a mounting surface of the compressor. The valve plate includes a suction chamber, a suction passage providing fluid communication between the suction chamber and a cylinder of the compressor, a suction valve seat through which the suction passage extends, and a discharge passage extending through the valve plate and defined by a discharge valve seat. The cylinder head at least partially covers the valve plate and defines a discharge chamber that is in selective fluid communication with the cylinder via the discharge passage. The cylinder head and the valve plate are formed together as a unitary body.

23 Claims, 11 Drawing Sheets

(51) Int. Cl.
*F04B 39/12* (2006.01)
*F04B 39/14* (2006.01)
*F04B 27/04* (2006.01)

(52) U.S. Cl.
CPC ..... *F04B 39/1086* (2013.01); *F04B 39/125* (2013.01); *F04B 39/14* (2013.01)

(56) References Cited

U.S. PATENT DOCUMENTS 947,536 A * 1/1910 Wenkel ..... A47K 5/1204 417/558
1,287,751 A * 12/1918 Richards ..... F16K 15/038 137/512.1
1,467,445 A * 9/1923 Meyers ..... F04B 27/005 137/454.4
1,652,978 A * 12/1927 Enock ..... F04B 39/1006 417/569
1,719,572 A * 7/1929 Stoll ..... F04B 39/10 137/512.3
1,739,603 A * 12/1929 McCune ..... F04B 39/1013 137/542
1,820,732 A * 8/1931 Davey ..... F04B 27/005 417/298
1,834,589 A * 12/1931 Holdsworth ..... F16K 15/02 137/543.19
1,998,444 A * 4/1935 Clapp ..... F04B 39/102 137/543.19
2,000,735 A * 5/1935 Arnold ..... F04B 39/102 137/315.01
2,011,563 A * 8/1935 Balfe ..... F16J 15/122 277/592
2,062,206 A 11/1936 Browne
2,062,816 A * 12/1936 Mercer ..... F04B 39/1033 137/512
2,359,486 A * 10/1944 Magis ..... F04B 7/04 137/454.4
2,431,733 A * 12/1947 Crittenden ..... F04B 39/1013 137/512.1
2,522,962 A * 9/1950 Reger ..... A62C 13/003 137/72
2,565,564 A * 8/1951 Lamberton ..... F04B 39/1033 417/446
2,579,667 A * 12/1951 Hanson ..... F04B 39/1033 137/512.2
2,815,901 A * 12/1957 Hale ..... F04B 27/00 417/534
4,059,367 A * 11/1977 Marshall ..... F04B 27/005 417/203
4,329,125 A * 5/1982 Chambers ..... F04B 39/102 137/543.17
4,368,755 A 1/1983 King
4,385,872 A 5/1983 Anderson
4,445,534 A * 5/1984 King ..... F04B 39/10 137/512.3
4,478,243 A 10/1984 King
4,685,489 A 8/1987 Yun et al.
4,699,572 A * 10/1987 Balkau ..... F04B 25/02 417/254
5,170,752 A * 12/1992 Binversie ..... F01P 11/04 123/41.08
5,427,506 A 6/1995 Fry et al.
5,678,983 A 10/1997 Lilie
7,040,877 B2 5/2006 Bergman et al.
2005/0169785 A1 8/2005 Majerus et al.
2006/0034707 A1 2/2006 Thomas et al.
2008/0063551 A1* 3/2008 Cornwell ..... F04B 39/0027 417/571
2008/0237510 A1* 10/2008 Chou ..... F04B 35/01 251/15
2011/0158825 A1* 6/2011 Speir ..... F04B 39/121 417/53
2014/0003986 A1 1/2014 Elson
2017/0321678 A1 11/2017 Kolpe

FOREIGN PATENT DOCUMENTS

CN 104583595 A 4/2015
CN 206917826 U 1/2018
EP 1041283 A2 10/2000
WO WO-2013182409 A1 12/2013
WO WO-2016052318 A1 4/2016

OTHER PUBLICATIONS

First Office Action and Search Report regarding Chinese Patent Application No. CN201710318366.7, dated Sep. 12, 2018. Translation provided by Unitalen Attorneys at Law.
U.S. Appl. No. 15/583,491, filed May 1, 2017, Devanawar et al.
International Search Report regarding International Application No. PCT/US2017/031357, dated Aug. 16, 2017.
Written Opinion of the International Searching Authority regarding International Application No. PCT/US2017/031357, dated Aug. 16, 2017.
Restriction Requirement regarding U.S. Appl. No. 15/583,491 dated Nov. 16, 2018.
Non-Final Office Action regarding U.S. Appl. No. 15/583,491 dated Apr. 2, 2019.
Second Office Action and Search Report regarding Chinese Patent Application No. CN201710318356.3, dated May 7, 2019, translation provided by Unitalen Attorneys at Law, 14 pages.
Third Office Action and Search Report regarding Chinese Patent Application No. CN201710318356.3, dated Nov. 4, 2019, translation provided by Unitalen Attorneys at Law, 12 pages.
Fourth Office Action and Search Report regarding Chinese Patent Application No. CN201710318356.3, dated Jun. 1, 2020 translation provided by Unitalen Attorneys at Law, 14 pages.
U.S. Appl. No. 15/583,491, filed May 1, 2017, Siddharth Dhanpal Devanawar.
First Examination Report dated Dec. 2, 2020 corresponding to Indian Patent Application No. 201621016024, 7 pages.

* cited by examiner

CYLINDER HEAD ASSEMBLY FOR A RECIPROCATING COMPRESSOR INCLUDING A CYLINDER HEAD WITH AN INTEGRAL VALVE PLATE

CROSS-REFERENCE TO RELATED APPLICATIONS

This application claims the benefit of Indian Patent Application No. 201621016024, filed on May 7, 2016, and Indian Patent Application No. 201624034755, filed on Oct. 11, 2016. The entire disclosures of the applications referenced above are incorporated herein by reference.

FIELD

The present disclosure relates to a cylinder head assembly for a reciprocating compressor including a cylinder head with an integral valve plate.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a cylinder head assembly for a compressor. The cylinder head assembly includes a valve plate and a cylinder head. The valve plate is configured to mount to a mounting surface of the compressor. The valve plate includes a suction chamber, a suction passage providing fluid communication between the suction chamber and a cylinder of the compressor, a suction valve seat through which the suction passage extends, and a discharge passage extending through the valve plate and defined by a discharge valve seat. The cylinder head at least partially covers the valve plate and defines a discharge chamber that is in selective fluid communication with the cylinder via the discharge passage. The cylinder head and the valve plate are formed together as a unitary body.

In some configurations, the valve plate forms a bottom wall of the cylinder head, and the cylinder head further includes a sidewall projecting from the valve plate and a top wall disposed opposite of the valve plate. The valve plate, the sidewall, and the top wall cooperate to define the discharge chamber.

In some configurations, the cylinder head includes a support post extending from the top wall of the cylinder head to the valve plate.

In some configurations, the top wall of the cylinder head defines a mounting hole that is concentrically aligned with the discharge passage.

In some configurations, the cylinder head assembly further includes a discharge valve assembly including a discharge valve, a biasing member, and a retainer. The discharge valve selectively seats against the discharge valve seat to prevent fluid communication between the cylinder and the discharge chamber. The biasing member biases the discharge valve against the discharge valve seat. The retainer extends through the mounting hole toward the discharge valve seat to retain the discharge valve in a vicinity of the discharge valve seat.

In some configurations, the discharge valve seat has a conical surface and the discharge valve has a beveled edge configured to seat against the conical surface.

In some configurations, the retainer includes a mounting flange configured to be mounted to an outer top surface of the cylinder head, a cylindrical body projecting from the mounting flange, and a plurality of extensions projecting from the cylindrical body and defining a pocket therebetween for retaining the discharge valve.

In some configurations, the discharge valve seat includes a radially inner wall extending around the discharge passage and configured to support the discharge valve. The discharge valve seat defines an annular pocket disposed about the radially inner wall. The extensions on the retainer extend into the annular pocket and surround the discharge valve to capture the discharge valve therebetween.

In some configurations, the top wall of the cylinder head defines blind holes adjacent to the mounting hole, and the mounting flange of the retainer defines holes extending therethrough that are concentrically alignable with corresponding ones of the blind holes.

In some configurations, the cylinder head assembly further includes a plurality of retainer bolts configured to be inserted through the holes in the mounting flange of the retainer and into the corresponding blind holes in the top wall of the cylinder head to secure the retainer to the cylinder head.

In some configurations, the cylinder head includes a plurality of bosses extending from an underside of the top wall and concentrically aligned with corresponding ones of the blind holes. The blind holes extend at least partially through the corresponding bosses.

In some configurations, the cylinder head includes a plurality of ribs that project from an underside surface of the top wall and from an interior surface of the sidewall.

In some configurations, the cylinder head defines a plurality of holes disposed about the perimeter of the cylinder head and extending through the top wall and the sidewall. The plurality of ribs include an annular rib that extends around the mounting hole and a plurality of linear ribs that extend from the mounting hole toward the plurality of holes.

In another form, the present disclosure provides a discharge valve assembly for a compressor. The discharge valve assembly includes a discharge valve, a biasing member, and a retainer. The discharge valve is configured to seat against a discharge valve seat defined by a valve plate to prevent fluid communication between a cylinder of the compressor and a discharge chamber within a cylinder head that covers the valve plate. The biasing member is configured to bias the discharge valve against the discharge valve seat. The retainer is configured to extend through a top wall of the cylinder head and toward the discharge valve seat to retain the discharge valve in a vicinity of the discharge valve seat.

In some configurations, the retainer includes a mounting flange configured to be mounted to an outer top surface of the cylinder head, a cylindrical body projecting from the mounting flange and configured to extend through the top wall of the cylinder head, and a plurality of extensions projecting from the cylindrical body and defining a pocket therebetween for retaining the discharge valve.

In some configurations, at least a portion of a bottom surface of the mounting flange is roughened to provide a seal between the bottom surface of the mounting flange and an outer top surface of the cylinder head.

In some configurations, the discharge valve has a discus puck shape.

In some configurations, the discharge valve has a flat disk shape.

In another form, the present disclosure provides a compressor including a housing, a piston, a valve plate, and a cylinder head. The housing defines a cylinder and having a mounting surface surrounding an opening of the cylinder. The piston is disposed within the housing, movable within the cylinder, and defines a compression chamber within the cylinder. The valve plate is configured to mount to the mounting surface of the compressor. The valve plate includes a suction chamber, a suction passage providing fluid communication between the suction chamber and the compression chamber, a suction valve seat through which the suction passage extends, and a discharge passage extending through the valve plate and defined by a discharge valve seat. The cylinder head at least partially covers the valve plate and defines a discharge chamber that is in selective fluid communication with the compression chamber via the discharge passage. The cylinder head and the valve plate are formed together as a unitary body.

In some configurations, the valve plate forms a bottom wall of the cylinder head, and the cylinder head further including a sidewall projecting from the valve plate and a top wall disposed opposite of the valve plate. The valve plate, the sidewall, and the top wall cooperate to define the discharge chamber.

In some configurations, the top wall of the cylinder head defines a mounting hole that is concentrically aligned with the discharge passage.

In some configurations, the compressor further includes a discharge valve assembly including a discharge valve, a biasing member, and a retainer. The discharge valve selectively seats against the discharge valve seat to prevent fluid communication between the cylinder and the discharge chamber. The biasing member biases the discharge valve against the discharge valve seat. The retainer extends through the mounting hole toward the discharge valve seat to retain the discharge valve in a vicinity of the discharge valve seat.

In some configurations, the discharge valve seats against the discharge valve seat when a force acting on the discharge valve due to pressure in the compression chamber is less than a biasing force applied by the biasing member to bias the discharge valve against the discharge valve seat.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
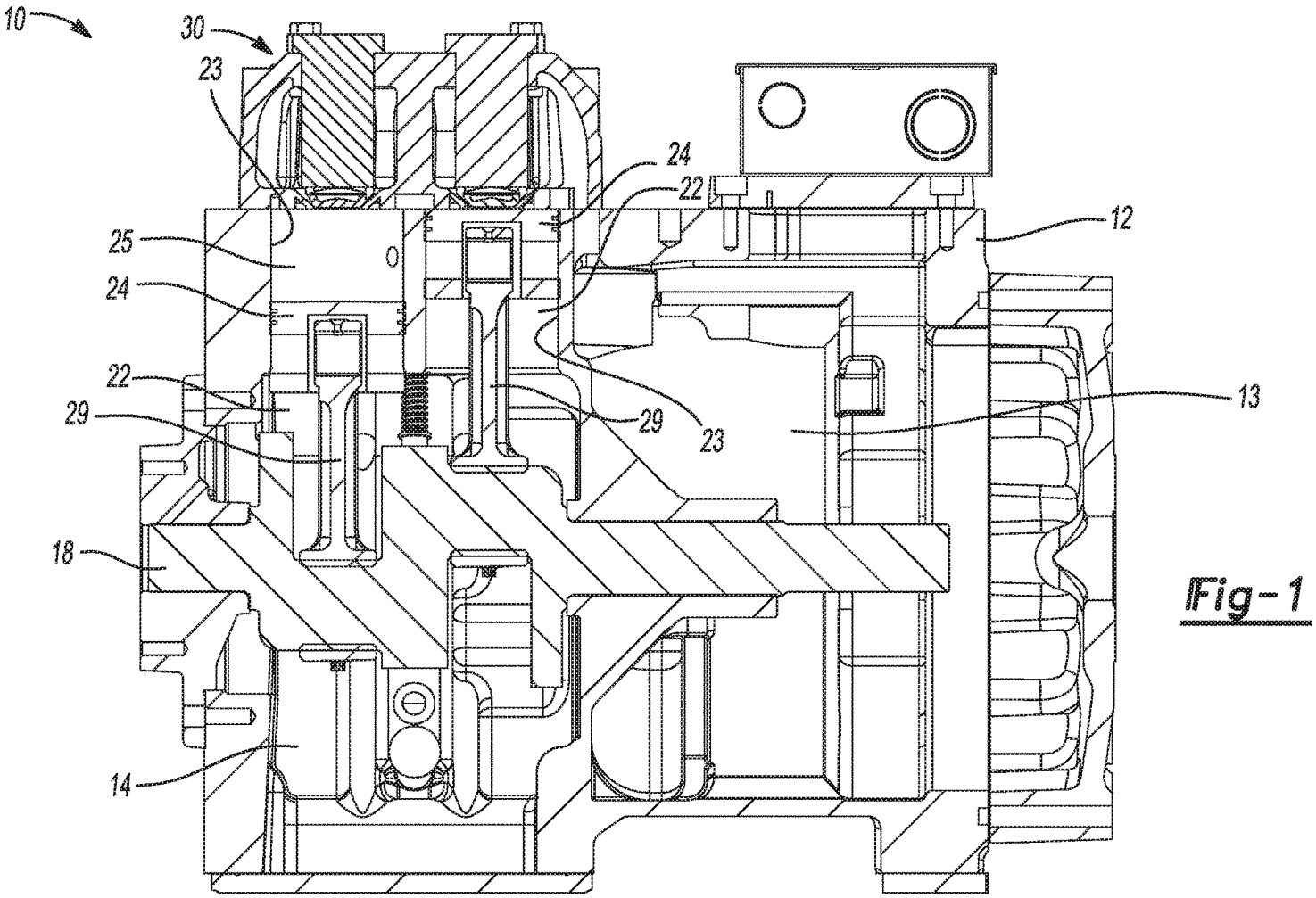
FIG. 1 is a cross-sectional view of a compressor having a cylinder head assembly including a cylinder head with an integral valve plate according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Reciprocating compressors typically include a shell that defines one or more cylinders and a cylinder head assembly that cooperates with the cylinders to define compression chambers. The cylinder head assembly typically includes a cylinder head and a valve plate. The cylinder head covers the cylinders, supplies suction-pressure working fluid to the compression chambers, and receives discharge-pressure working fluid from the compression chambers. The valve plate separates the suction-pressure working fluid and the discharge-pressure working fluid from each other as the two pressure levels of working fluid flow between the interior of the cylinder head and the compression chambers. In this regard, the valve plate typically includes a suction passage for the suction-pressure working fluid and a discharge passage for the discharge-pressure working fluid.

In convention cylinder head assemblies, the valve plate is formed separate from the cylinder such that the cylinder head and the valve plate are two separate and distinct components. An example of such a cylinder head assembly is disclosed in U.S. Pat. No. 7,040,877 (see, e.g., elements 14 and 18 of FIG. 3 of the '877 patent). In contrast, a cylinder head assembly according to the present disclosure includes a cylinder head and a valve plate that are formed (e.g., cast and/or machined) together as a unitary body. Integrally forming the cylinder head and the valve plate reduces the number of parts in the cylinder head assembly, improves the ease of manufacturing and assembling the cylinder head assembly, and enables the overall size of the cylinder head assembly to be reduced.

In addition, with most conventional reciprocating compressor designs, integrally forming the valve plate with the cylinder head is not possible due to the design of a discharge valve that regulates the flow of the discharge-pressure working fluid from the compression chamber to the interior of the cylinder head. To this end, in conventional reciprocating compressor designs, the discharge valve is typically mounted to the valve plate. An example of such a discharge valve is disclosed in the '877 patent (see, e.g., elements 18, 48, and 52 of FIG. 3 of the '877 patent). Then, when the cylinder head is assembled to the valve plate, the cylinder head completely encloses the discharge valve. Thus, if the valve plate was integrally formed with the cylinder head, there would be no way to assemble the discharge valve to the valve plate.

In contrast, a cylinder head assembly according to the present disclosure includes a cylinder head that defines a mounting hole and a discharge valve assembly that extends through the mounting hole to the discharge passage. Thus, in contrast to conventional reciprocating compressor designs, the discharge valve assembly can be assembled to the cylinder head assembly after the cylinder head assembly is assembled to the shell of the compressor. In addition, the discharge valve assembly can be serviced without disassembling the cylinder head from the compressor shell.

Further, in some conventional cylinder head assemblies, the valve plate is an assembly of three plates—a top plate, a middle plate, and a bottom plate. These three plates are manufactured individually by a stamping process, and then the top and bottom faces of the plates are precisely machined. The three plates are then stacked and brazed together with posts therebetween. An example of such a valve plate is disclosed in the '877 patent (see, e.g., elements 18, 26, 28, 30, 32, and 34 of FIG. 3 of the '877 patent). After brazing, the valve plate is heat treated and once again machined. These processes are time consuming and costly, and may require transporting the valve plate to multiple manufacturing facilities. Thus, relative these valve plate designs, integrally forming the cylinder head and the valve plate even further reduces the number of parts in the cylinder head assembly and improves the ease of manufacturing and assembling the cylinder head assembly.

Referring now to FIG. 1, a compressor 10 (e.g., a reciprocating compressor) includes a shell or housing 12 defining a suction plenum 13 and an interior volume 14 in which a motor (not shown) and a crankshaft 18 are disposed. The housing 12 includes one or more cylinders 22 (i.e., cylindrical bores). Each of the cylinders 22 slidably receives a piston 24. Each cylinder 22 and corresponding piston 24 cooperate with a cylinder head assembly 30 to define a compression chamber 25. Each piston 24 may include piston rings that sealingly and slidably contact an inner diametrical surface 23 of a corresponding one of the cylinders 22. Each piston 24 is drivingly connected to the crankshaft 18 by a connecting rod 29 so that rotation of the crankshaft 18 (driven by the motor) causes the piston 24 to reciprocate within the corresponding cylinder 22.

Figure 2:
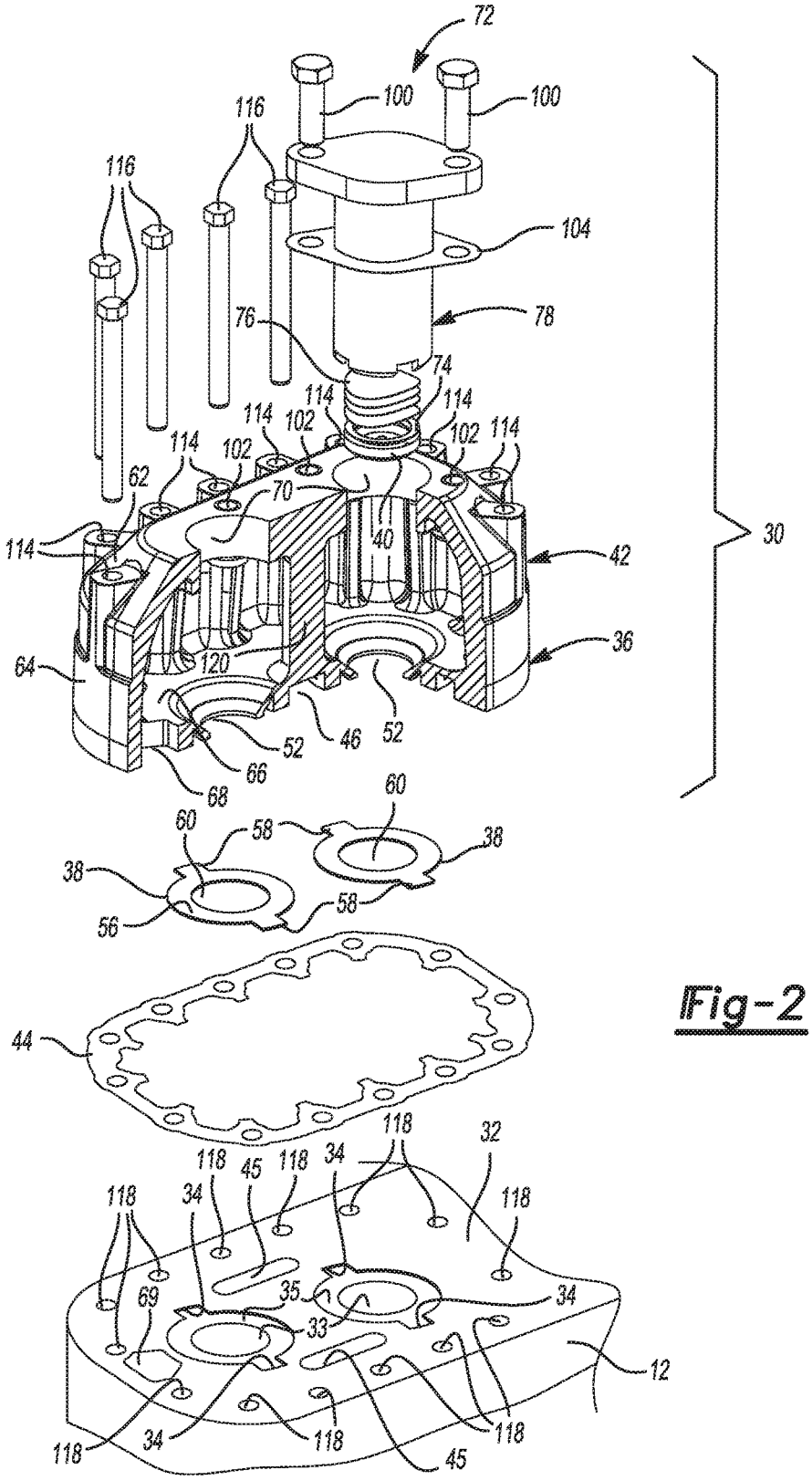
FIG. 2 is an exploded perspective view of the cylinder head assembly and a portion of the compressor including a mounting surface for the cylinder head assembly.
Figure 12:
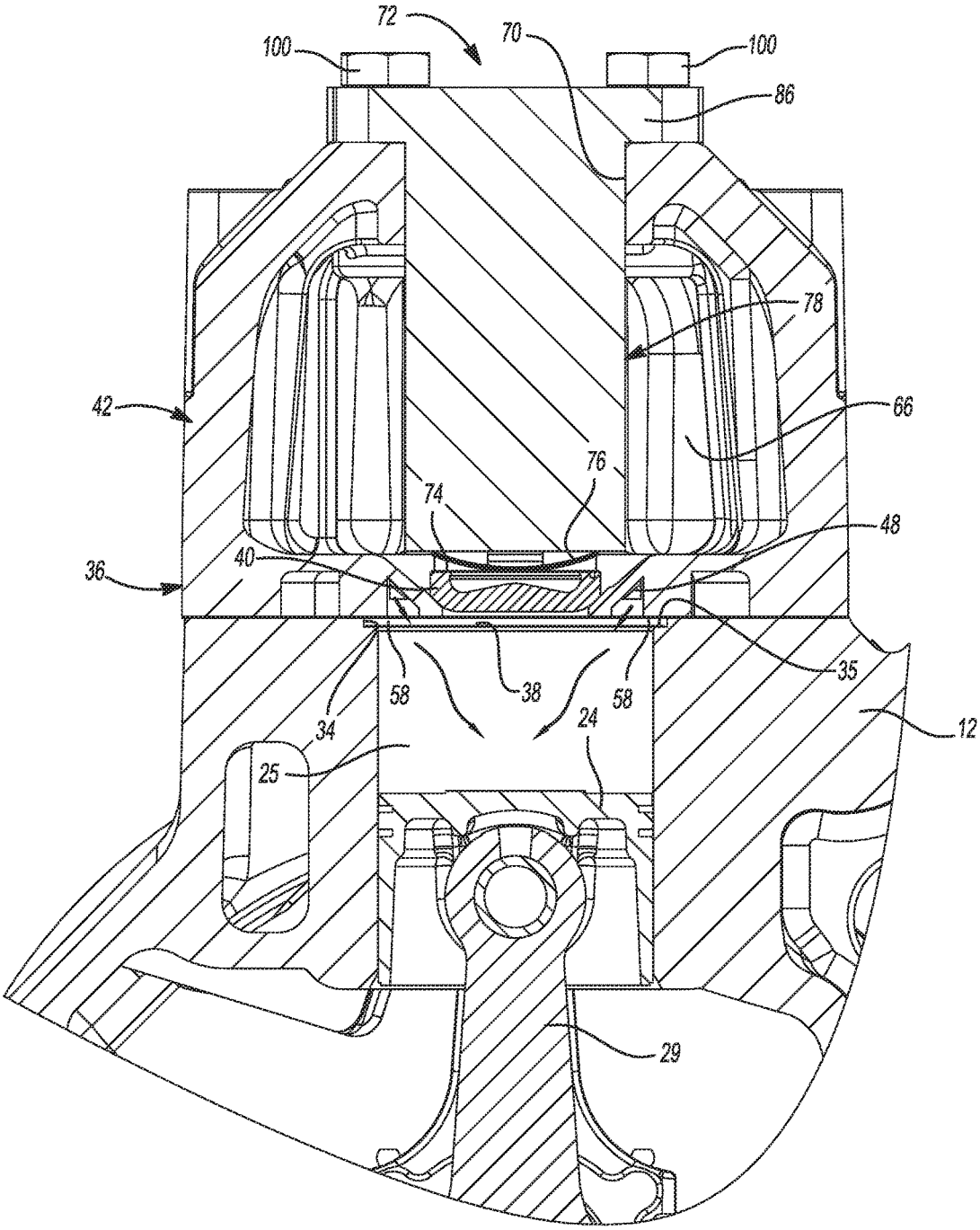
FIG. 12 is a cross-sectional view of the cylinder head assembly and a portion of the compressor during a suction stroke.
Figure 13:
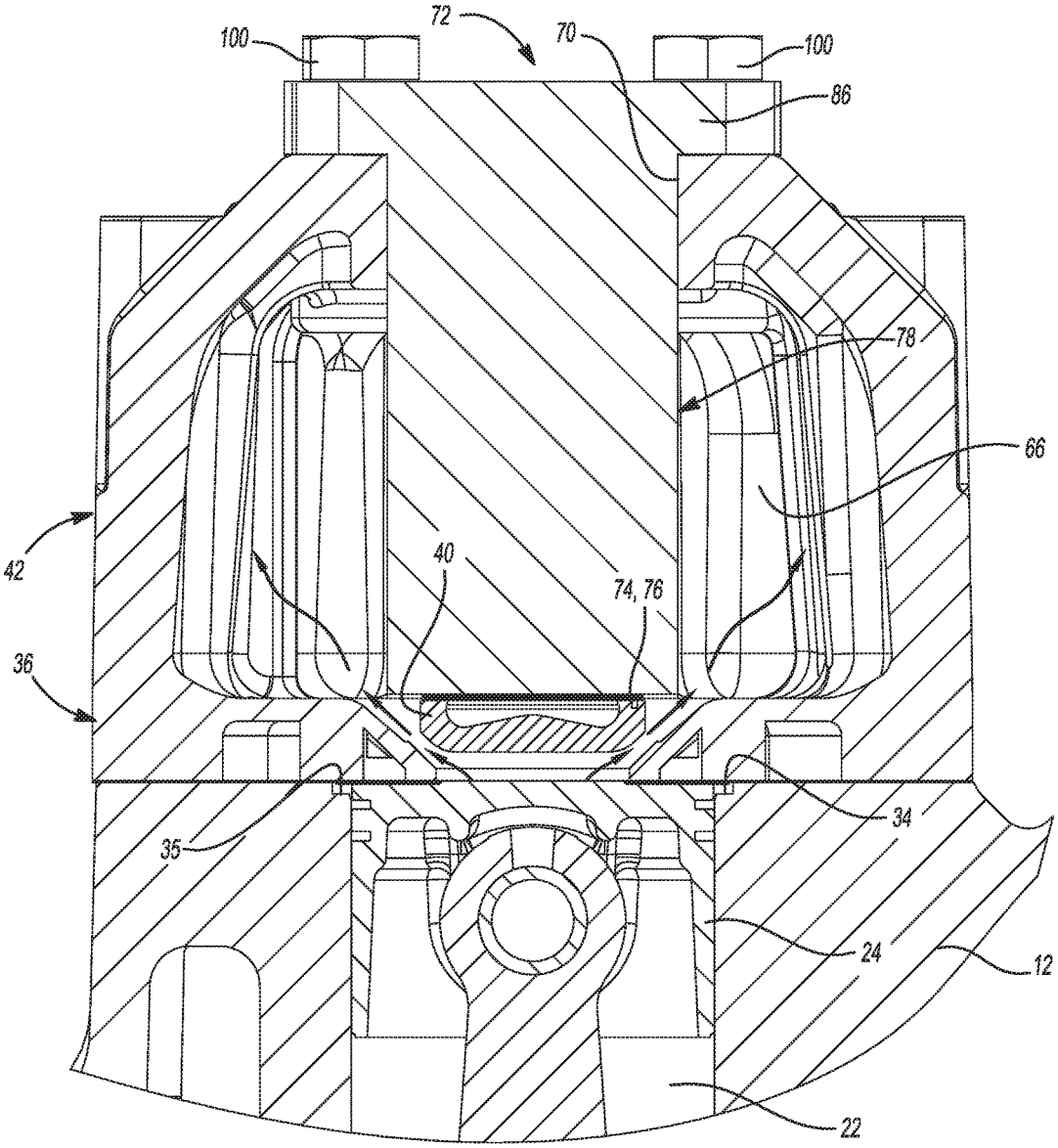
FIG. 13 is a cross-sectional view of the cylinder head assembly and a portion of the compressor during a discharge stroke.

As shown in FIGS. 2, 12, and 13, the housing 12 includes a mounting surface 32 through which the cylinders 22 extend such that the mounting surface 32 defines openings 33 of the cylinders 22. The cylinder head assembly 30 may be attached to the mounting surface 32 via a plurality of fasteners (not shown), for example. The mounting surface 32 may also define a plurality of recesses 34 that are open to the cylinders 22. The recesses 34 extend radially outward (i.e., in a radial direction relative to longitudinal axes of the cylinders 22) from the inner diametrical surfaces 23 of the cylinders 22. The recesses 34 also extend from the mounting surface 32 in a direction parallel to the longitudinal axes of the cylinders 22. The recesses 34 are defined by ledges 35 that cooperate to define a first valve seat.

Figure 3:
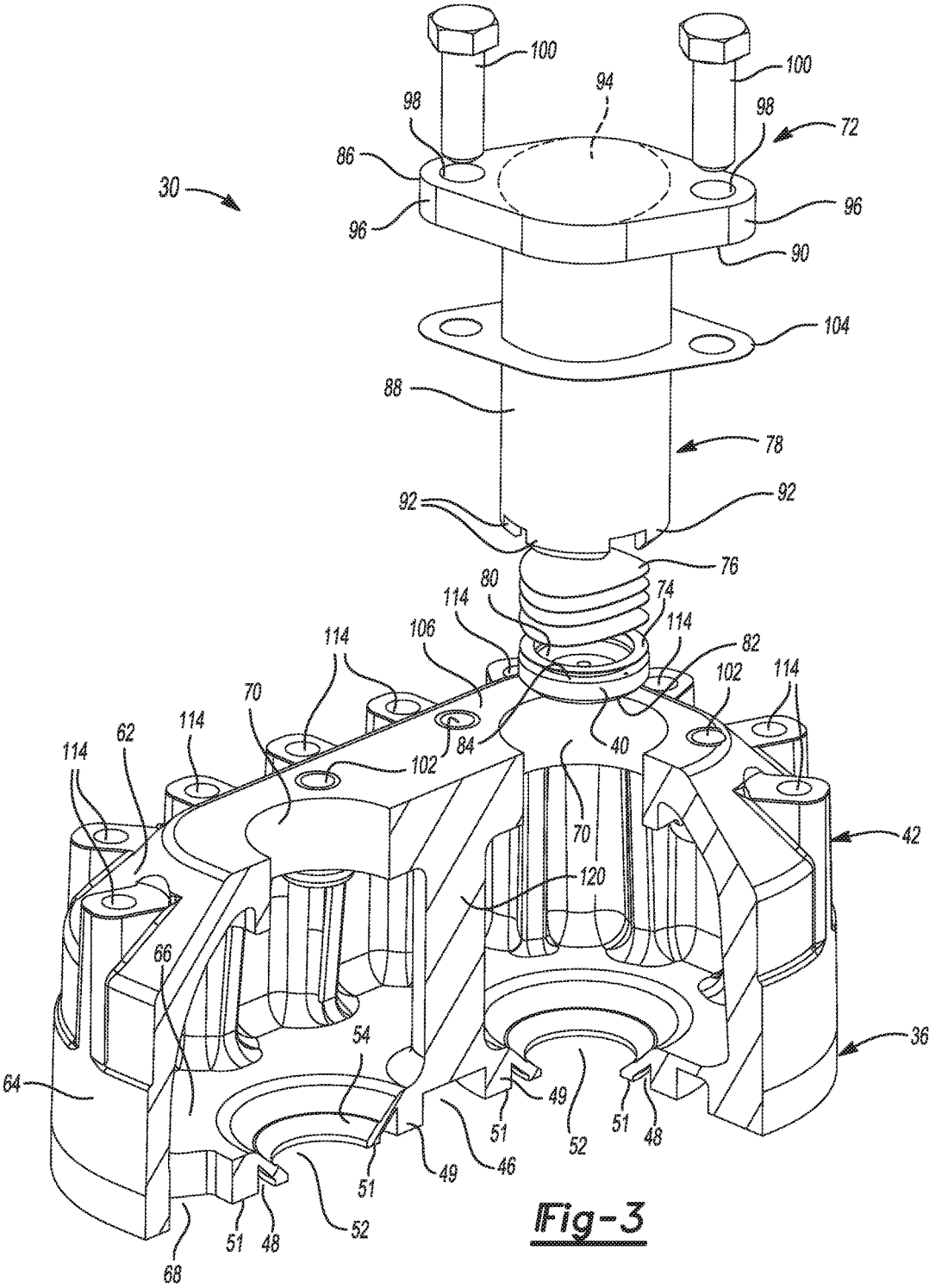
FIG. 3 is an exploded and partial cross-sectional perspective view of the cylinder head assembly.
Figure 4:
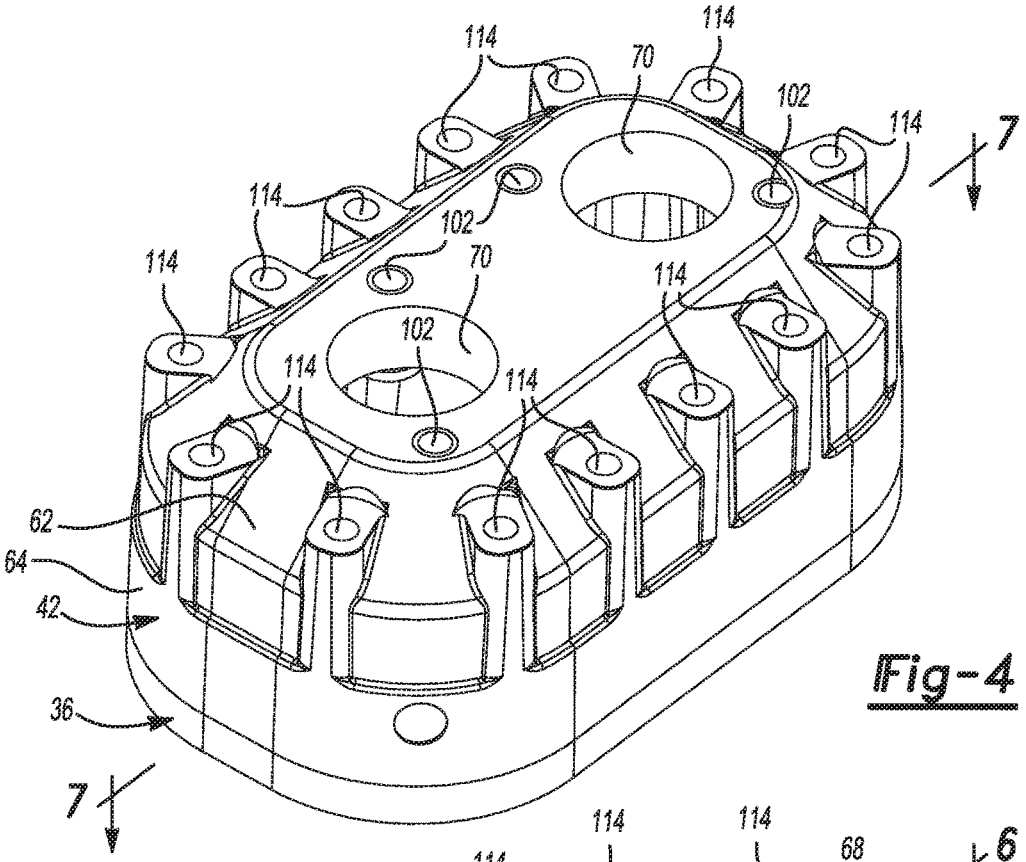
FIG. 4 is a perspective view of a top side of the cylinder head and integral valve plate.
Figure 5:
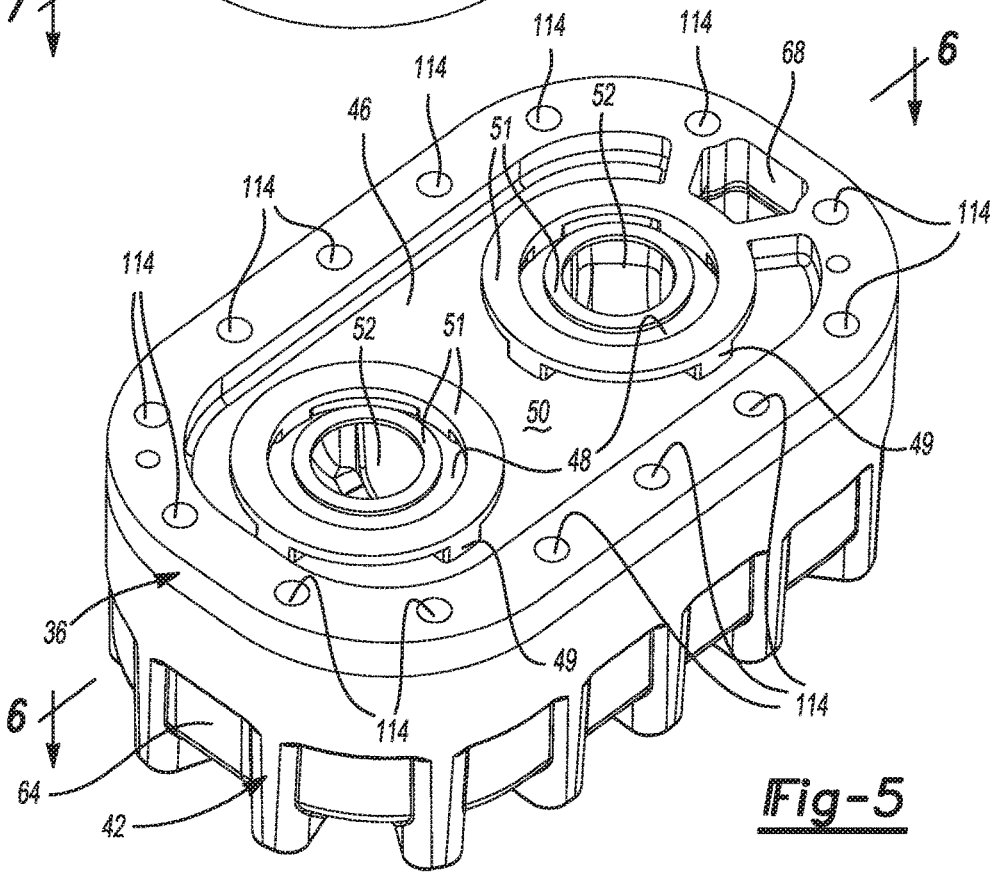
FIG. 5 is a perspective view of a bottom side of the cylinder head and integral valve plate.

As shown in FIGS. 2 and 3, the cylinder head assembly 30 includes a valve plate 36, one or more floating suction valves 38, one or more discharge valves 40, and a cylinder head 42. The valve plate 36 is integrally formed with the cylinder head 42. For example, the valve plate 36 and the cylinder head 42 may be cast and/or machined together as a unitary body. The valve plate 36 is mounted to the mounting surface 32 of the housing 12. As shown in FIG. 2, a first gasket 44 may be disposed between the valve plate 36 and the mounting surface 32 to provide a sealed relationship therebetween, and suction passages 45 in the housing 12 may extend through the mounting surface 32. As shown in FIGS. 2, 3, 5, and 9A, the valve plate 36 may include a suction chamber 46, which is an internal cavity that functions as a suction manifold that receives suction-pressure working fluid from the suction plenum 13 within the housing 12 through the suction passages 45 in the housing 12.

With reference to FIGS. 3, 5, 9A, and 9B, the valve plate 36 may include a plurality of annular suction outlet passages 48. Each suction outlet passage 48 provides fluid communication between the suction chamber 46 and a corresponding one of the cylinders 22. The valve plate 36 includes a plurality of suction valve retainers 49 that each has an annular body projecting from an underside surface 50 of the valve plate 36 to define the suction chamber 46. Each of the suction valve retainers 49 define lower planar surfaces 51 that define a plurality of second valve seats against which the suction valves 38 can selectively seat to seal off the suction outlet passages 48 from the cylinders 22. In this regard, the second valve seats may be referred to as suction valve seats.

The valve plate 36 also defines a plurality of discharge passages 52 that are each defined by a corresponding third valve seat 54. The discharge passages 52 are in selective fluid communication with one of the cylinders 22. The third valve seats 54 may be generally conical surfaces against which the discharge valves 40 can selectively seat to seal off the discharge passage 52 from the cylinders 22. In this regard, the third valve seats may be referred to as discharge valve seats.

As shown in FIG. 2, the suction valves 38 may be thin, annular reed valves that include an annular main body 56 and a plurality of lobes 58 that extend radially outward (i.e., relative to longitudinal axes of the cylinders 22) from the main body 56. As shown in FIG. 12, at least a portion of each of the lobes 58 may be movably received in a corresponding one of the recesses 34 formed in the housing 12 such that the lobes 58 may contact the ledges 35 to support the suction valve 38 when the suction valve 38 is in an open position. In the open position, the suction valve 38 allows suction-pressure working fluid to flow from the suction chamber 46 to a corresponding cylinder 22 through a corresponding suction outlet passage 48. Each suction valve 38 is movable between the open position and a closed position in which the main body 56 sealingly contacts the corresponding planar surface 51 of the valve plate 36 to restrict or prevent fluid flow through the corresponding suction outlet passage 48.

As shown in FIG. 2, an aperture 60 extends through the main body 56 of each suction valve 38. The aperture 60 in each suction valve 38 may be concentrically aligned with a corresponding one of the discharge passages 52 such that working fluid can flow from the cylinders 22 through the apertures 60 and into the discharge passages 52.

While the figures depict each cylinder 22 having a plurality of discrete recesses 34, in some configurations, each cylinder 22 could have a single continuous recess 34 that extends angularly around the inner diametrical surface 23 of the cylinder 22. In such configurations, the suction valves 38 may not include any lobes 58. It will be appreciated, however, that each cylinder 22 could have any number of recesses 34 and the suction valves 38 could have any number of lobes 58. The recesses 34 and lobes 58 can be shaped in any suitable manner.

Referring now to FIGS. 2-5, the valve plate 36 forms a bottom wall of the cylinder head 42, and the cylinder head 42 further includes a top wall 62 disposed opposite of the valve plate 36 and a sidewall 64 extending around the perimeter of the cylinder head 42. The valve plate 36, the top wall 62, and the sidewall 64 cooperate to define a discharge chamber 66 within the cylinder head 42. The discharge chamber 66 receives compressed working fluid (e.g., discharge-pressure working fluid) from the cylinders 22 via discharge passages 52. The compressed working fluid in the discharge chamber 66 may exit the compressor 10 through a discharge port 68 in the valve plate 36 and through a discharge port 69 in the housing 12 that may be connected to a condenser or gas cooler (not shown).

A plurality of mounting holes 70 extend through the top wall 62 of the cylinder head 42. Each of the mounting holes 70 is configured to receive a discharge valve assembly 72 that includes the discharge valve 40, a spacer 74, a biasing member 76, and a retainer 78. The discharge valve assembly 72 may be considered part of the cylinder head assembly 30. The discharge valve 40 is movable between a closed position (shown in FIGS. 8, 9A, 9B, and 12) and an open position (shown in FIG. 13). In the closed position, the discharge valve 40 sealingly contacts the corresponding third valve seat 54, thereby restricting or preventing fluid flow through the discharge passage 52. In the open position, the discharge valve 40 is spaced apart from the third valve seat 54, thereby allowing fluid flow from the cylinder 22 through the discharge passage 52.

Referring now to FIGS. 3, 8, 9A, and 9B, the discharge valve 40 may have a shape similar to a discus puck with an open end 80. In addition, the discharge valve 40 may have a beveled edge 82 that conforms to the conical surface of the corresponding third valve seat 54. The discharge valve 40 may be formed from PEEK (polyetheretherketone) or any other suitable material.

The biasing member 76 applies a biasing force to the discharge valve 40 to bias the discharge valve 40 toward the corresponding third valve seat 54. The biasing member 76 may be a crimp spring as shown. The discharge valve 40 seats against the corresponding third valve seat 54 when a force acting on the discharge valve 40 due to pressure in the compression chamber 25 is less than the biasing force applied to the discharge valve 40 by the biasing member 76. The spacer 74 is disposed between the biasing member 76 and the discharge valve 40 and may distribute the biasing force applied by the biasing member 76 around a top surface 84 of the discharge valve 40. The spacer 74 and the biasing member 76 may be formed from metal.

Figure 8:
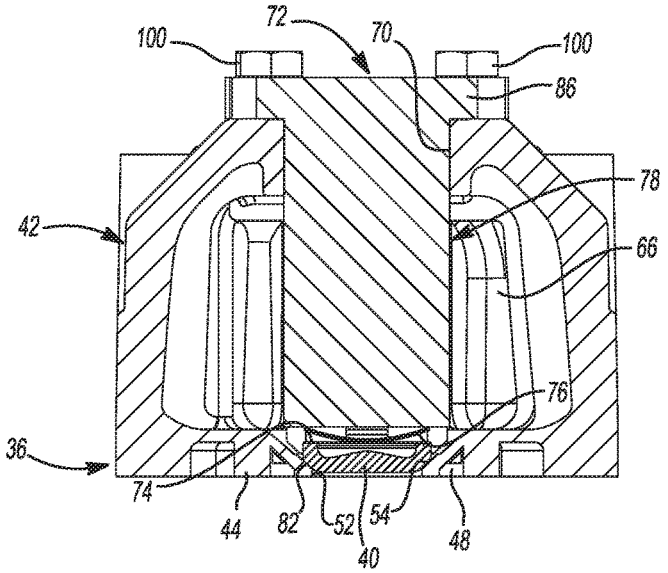
FIG. 8 is a cross-sectional view of the cylinder head assembly including a discharge valve having a discus puck shape.
Figure 9A:
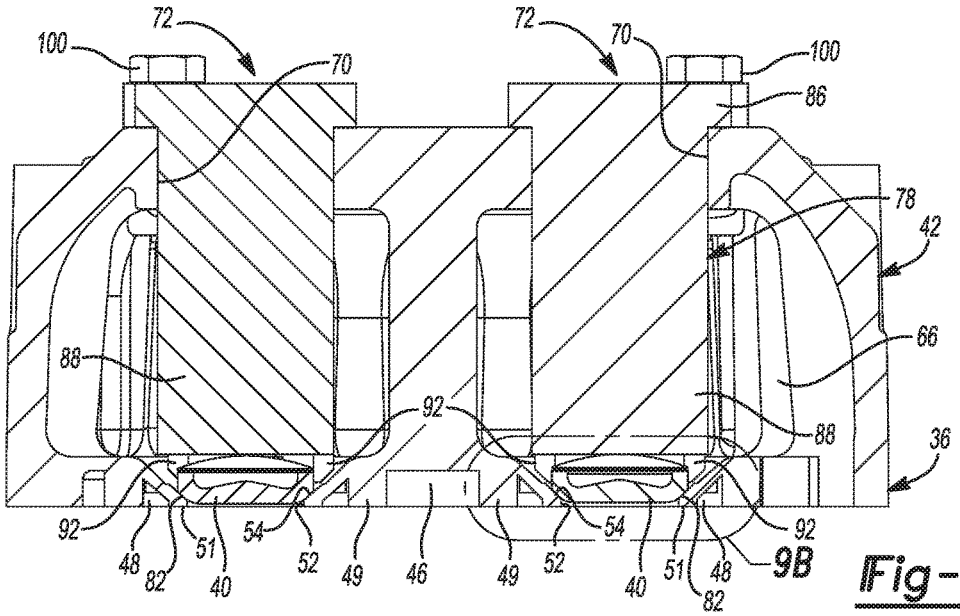
FIG. 9A is another cross-sectional view of the cylinder head assembly including multiple discharge valves having a discus puck shape.

As shown in FIGS. 8 and 9A, the retainer 78 extends through the corresponding mounting hole 70, through the discharge chamber 66, and toward the corresponding discharge passage 52 to retain the discharge valve 40 in a vicinity of the corresponding third valve seat 54. As shown in FIGS. 3, 8, 9A, 10, and 11, the retainer 78 includes a mounting flange 86, a cylindrical body 88 projecting axially from a bottom surface 90 of the mounting flange 86, and extensions 92 projecting axially from the cylindrical body 88. The mounting flange 86 is generally oblong with a circular head portion 94 that covers the corresponding mounting hole 70 and ears 96 that extend radially in opposite directions from the head portion 92. A plurality of fastener holes 98 extend through the ears 96 of the mounting flange 86. Fasteners 100 may be inserted through the fastener holes 98 in the mounting flange 86 of the retainer 78 and into corresponding threaded blind holes 102 in the top wall 62 of the cylinder head 42 to secure the discharge valve assembly 72 to the cylinder head 42.

As shown in FIGS. 2 and 3, a second gasket 104 may be disposed between the bottom surface 90 of the mounting flange 86 and an outer top surface 106 of the cylinder head 42 to provide a sealed relationship therebetween. Additionally or alternatively, the bottom surface 90 of the mounting flange 86 may include a roughened (e.g., serrated) portion 108 (FIG. 10) to provide a seal between the bottom surface 90 and the outer top surface 106 of the cylinder head 42. The roughened portion 108 of the bottom surface 90 may extend around the cylindrical body 88 of the retainer 78 as shown.

Figure 9B:
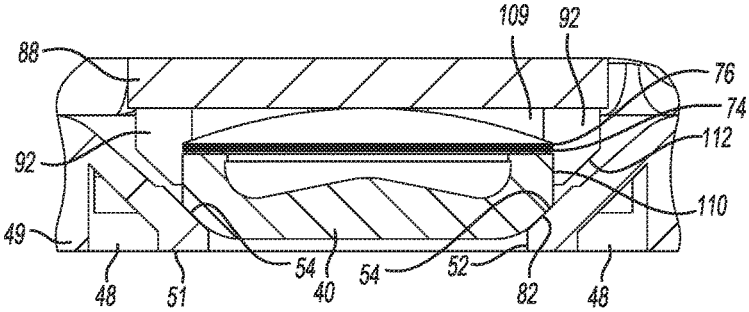
FIG. 9B is an enlarged cross-sectional view of a portion of the cylinder head assembly within circle 9B shown in FIG. 9A.
Figure 11:
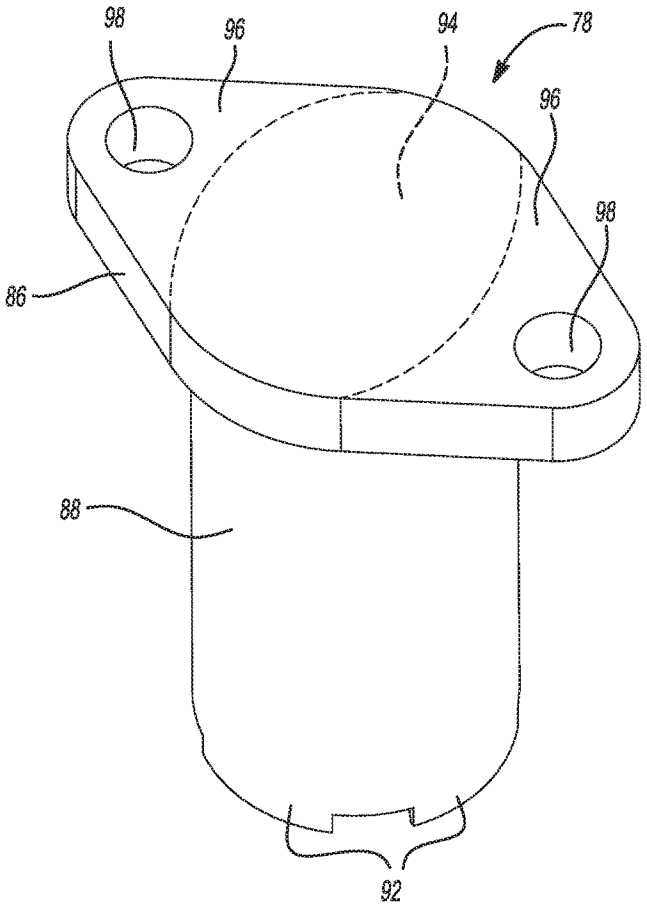
FIG. 11 is another perspective view of the retainer of FIG. 10.
Figure 10:
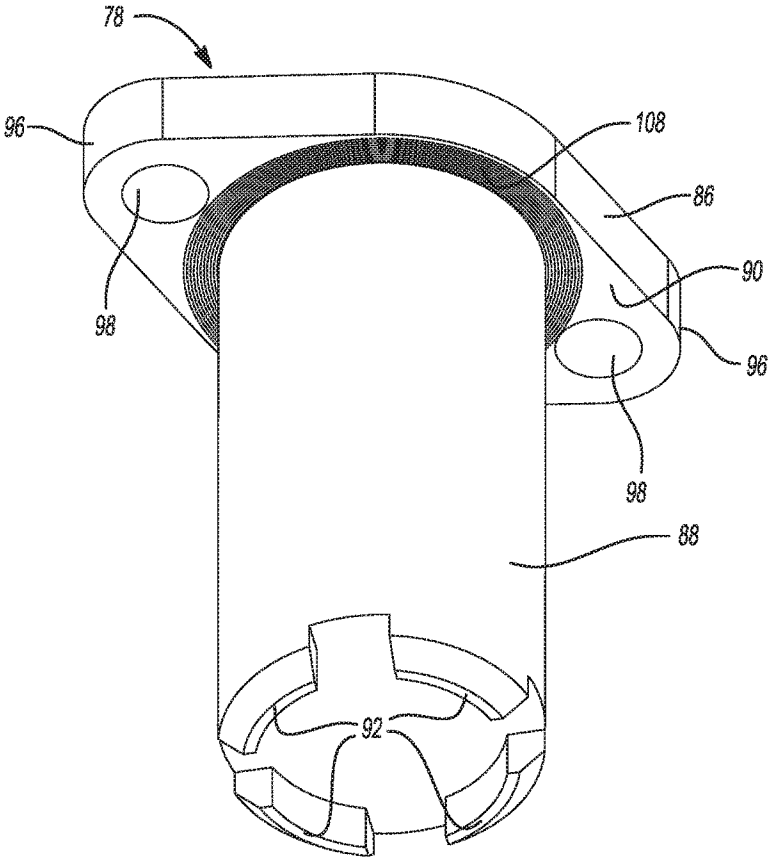
FIG. 10 is a perspective view of a retainer for the discharge valve.

As shown in FIGS. 8, 9A, and 9B, the discharge valve 40 is captured between the third valve seat 54, the extensions 92 of the retainer 78, and the cylindrical body 88 of the retainer 78. As shown in FIG. 9B, the extensions 92 of the retainer 78 cooperate to define a pocket 109 therebetween for retaining the discharge valve 40. The discharge valve 40 moves between its open and closed positions in the pocket 109 defined by the extension 92. In addition, the extensions 92 of the retainer 78 may engage a perimeter or side surface 110 of the discharge valve 40 to maintain the discharge valve 40 in an orientation in which the discharge valve 40 may seat against the third valve seat 54. In this regard, the extensions 92 may act as guide posts that maintain the orientation of the discharge valve 40 as the discharge valve 40 moves between its open and closed positions. Each of the extensions 92 may have a beveled edge 112 that conforms to the conical surface of the third valve seat 54.

Referring now to FIGS. 2-7, a plurality of holes 114 are disposed about the perimeter of the cylinder head 42 and extend through the top wall 62 and sidewall 64 of the cylinder head 42 and through the valve plate 36. Fasteners 116 may be inserted through the holes 114 and into corresponding holes 118 in the mounting surface 32 of the housing 12 to secure the cylinder head assembly 30 to the housing 12. As shown in FIGS. 2 and 3, the cylinder head 42 includes a support post 120 that extends from the top wall 62 of the cylinder head 42 to the valve plate 36. The support post 120 may be disposed at the center of the cylinder head 42 and between the mounting holes 70 as shown.

Figure 6:
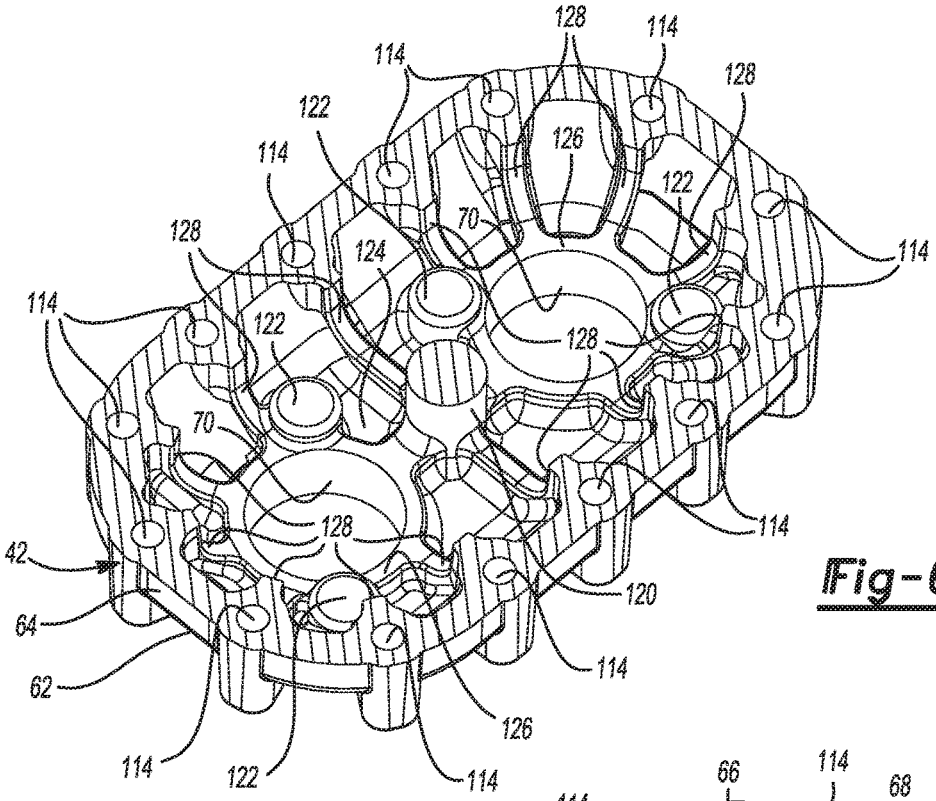
FIG. 6 is a cross-sectional perspective view of the cylinder head and integral valve plate taken along line 6-6 of FIG. 4.
Figure 7:
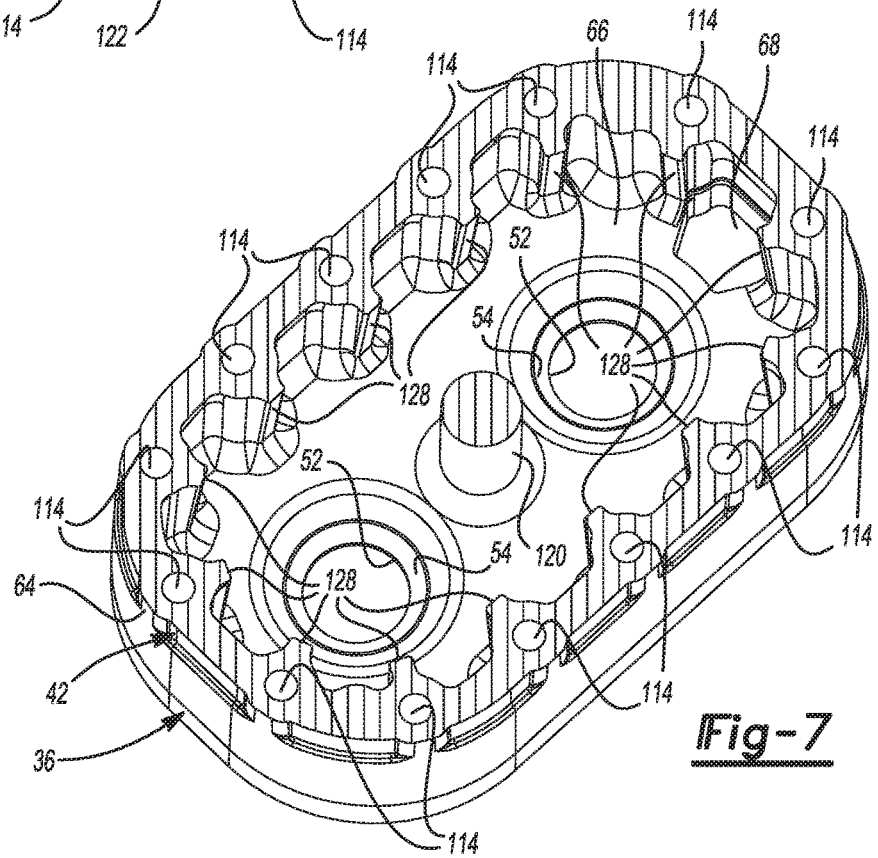
FIG. 7 is a cross-sectional perspective view of the cylinder head and integral valve plate taken along line 7-7 of FIG. 5.

As shown in FIG. 6, the cylinder head 42 also includes a plurality of bosses 122 that project from an underside surface 124 of the top wall 62. The bosses 122 are concentrically aligned with the threaded blind holes 102, and the threaded blind holes 102 extend at least partially into the bosses 122. The bosses 122 enabled the length of the threaded blind holes 102 to be greater than otherwise possible, which reduces the likelihood that the fasteners 100 will back out of the threaded blind holes 102.

Also shown in FIG. 6, the cylinder head 42 further includes a plurality of annular ribs 126 and a plurality of linear ribs 128. The annular ribs 126 project from the underside surface 124 of the top wall 62 and extend around the mounting holes 70. The linear ribs 128 project from the underside surface 124 of the top wall 62 and from an interior surface of the sidewall 64. The linear ribs 128 extend from the support post 120 or the annular ribs 126, toward the holes 114, and alongside the holes 114. The support post 120 and the annular and linear ribs 126 and 128 increase the strength of the valve plate 36 and the cylinder head 42.

With reference to FIGS. 1, 2, 8, 9A, 12, and 13, operation of the compressor 10 will be described in detail. Suction-pressure working fluid may enter the compressor 10 through a suction port (not shown) in the housing 12. From the suction port, the suction-pressure working fluid may enter the suction plenum 13 (FIG. 1) within the housing 12. From the suction plenum 13, the working fluid may be drawn into the suction chamber 46 (FIGS. 2 and 9A) in the valve plate 36 via suction passages 45 (FIG. 2) in the housing 12.

During the suction stroke of one of the pistons 24 within a corresponding cylinder 22 (i.e., while the piston 24 is moving away from the cylinder head assembly 30), low fluid pressure within the compression chamber 25 will cause the suction valve 38 to move into the open position (i.e., where the lobes 58 contact the ledges 35 of recesses 34). Movement of the suction valve 38 into the open position allows the working fluid in the suction chamber 46 to flow into the compression chamber 25 through the suction outlet passage 48 as indicated by the arrows in FIG. 12.

Because the outer diameter of the main body 56 of the suction valve 38 is less than the inner diameter of the cylinder 22 and because the main body 56 has the aperture 60, suction-pressure working fluid from the suction outlet passage 48 can flow around the outside of the main body 56 and through the aperture 60, thereby improving fluid flow into the compression chamber 25.

The low fluid pressure within the compression chamber 25 during the suction stroke of the piston 24 also causes the discharge valve 40 to move into the closed position (i.e., where the discharge valve 40 contacts the third valve seat 54 of the valve plate 36), thereby restricting or preventing fluid flow between the compression chamber 25 and the discharge chamber 74. As described above, the discharge valves 40 moves between the open and closed positions within the pockets 109 defined by the extensions 92 of the retainers 78.

The extensions 92 ensure that the discharge valves 40 seat properly on the third valve seats 54 during the suction stroke. The extensions 92 allow the discharge valves 40 to move only vertically (i.e., along the longitudinal axes of the cylinders 22) and perpendicular to the mounting surface 32. This ensures proper sealing of the discharge passages 52 and reduces wear on the discharge valves 40 and the third valve seats 54. Furthermore, the construction of the extensions 92 and the valve plate 36 allow the discharge valves 40 to be adequately retained without fasteners, pins or retainers, thereby simplifying assembly of the compressor 10.

After drawing suction-pressure working fluid into the compression chamber 25 during the suction stroke, the piston 24 moves back toward the cylinder head assembly 30 in a compression stroke. At the start of the compression stroke, increased fluid pressure within the compression chamber 25 (i.e., to a level higher than the fluid pressure within the suction chamber 46) forces the floating suction valve 38 upward toward the valve seat defined by surface 51 of the valve plate 36. As the suction valve 38 moves between its open and closed positions, the suction valve 38 is floating, i.e., the suction valve 38 is not retained by any solid structure above or below the suction valve 38. The higher fluid pressure within the compression chamber 25 during the compression stroke will retain the suction valve 38 in contact with the surface 51 to restrict or prevent fluid flow between the compression chamber 25 and the suction chamber 46.

The very short distance that the suction valves 38 must travel between the fully open and fully closed positions allows for nearly instantaneous opening and closing of the suction outlet passages 48, which improves efficiency and performance of the compressor 10. The thin structure and low mass of the suction valves 38 requires less work to move than conventional suction valves, which also improves efficiency and performance of the compressor 10. Furthermore, the manner in which the suction valves 38 interact with the recesses 34 allows the suction valves 38 to be installed and operate with pins, fasteners or retainers. This structure also simplifies manufacturing and assembly of the compressor 10.

Increasing fluid pressure within the compression chamber 25 during the compression stroke of the piston 24 also causes the discharge valve 40 to move into the closed position (i.e., where the discharge valve 40 is spaced apart from the third valve seat 54 of the valve plate 36), thereby allowing compressed working fluid in the compression chamber 25 to flow through the discharge passage 52 and into the discharge chamber 66 as indicated by the arrows in FIG. 13.

While the cylinder head assembly 30 is described above as being incorporated into a reciprocating compressor, it will be appreciated that the valve plate 36, suction valves 38, discharge valves 40 and the cylinder head 42 could be incorporated into other types of compressors, such as a rotary compressor, for example.

Figure 14A:
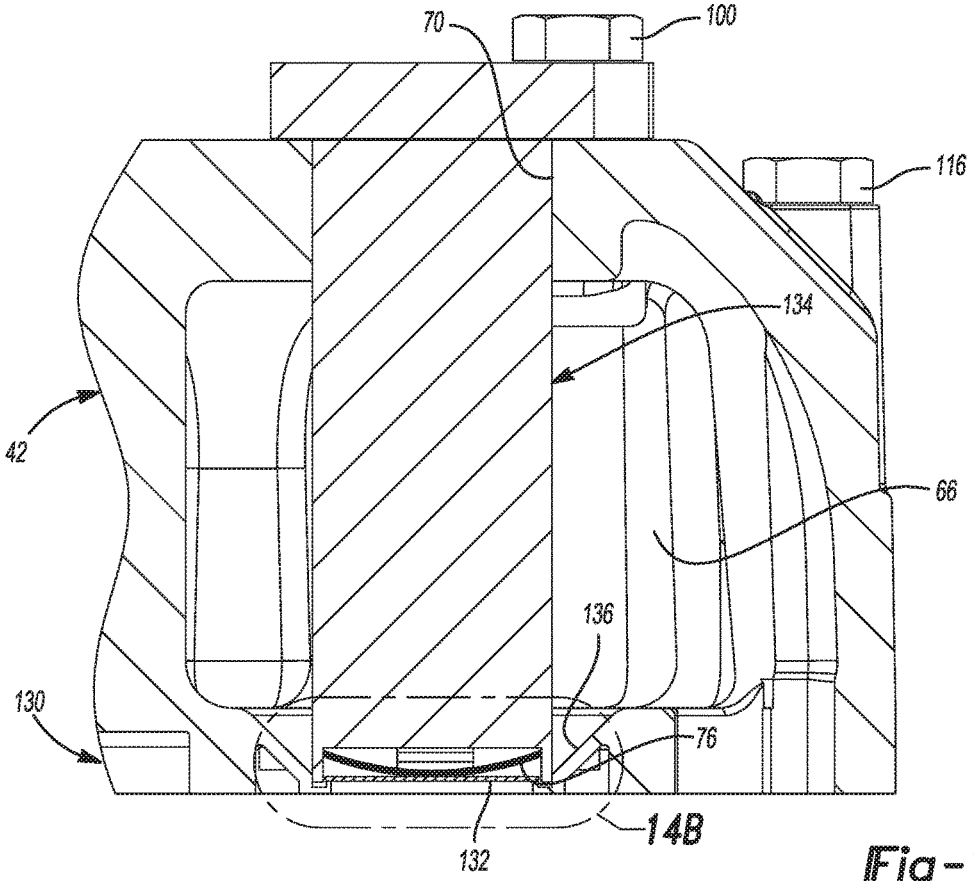
FIG. 14A is a cross-sectional view of a cylinder head assembly including a discharge valve having a flat disk shape.
Figure 14B:
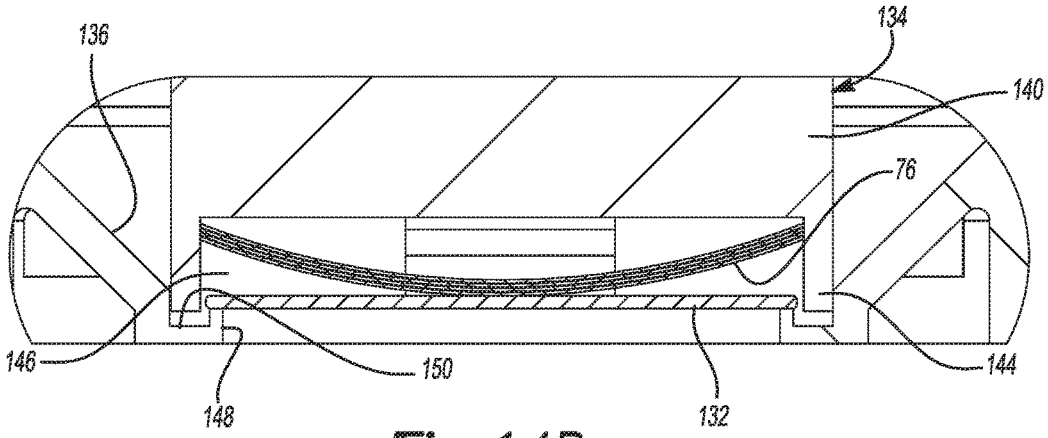
FIG. 14B is an enlarged cross-sectional view of a portion of the cylinder head assembly within circle 14B shown in FIG. 14A.
Figure 15:
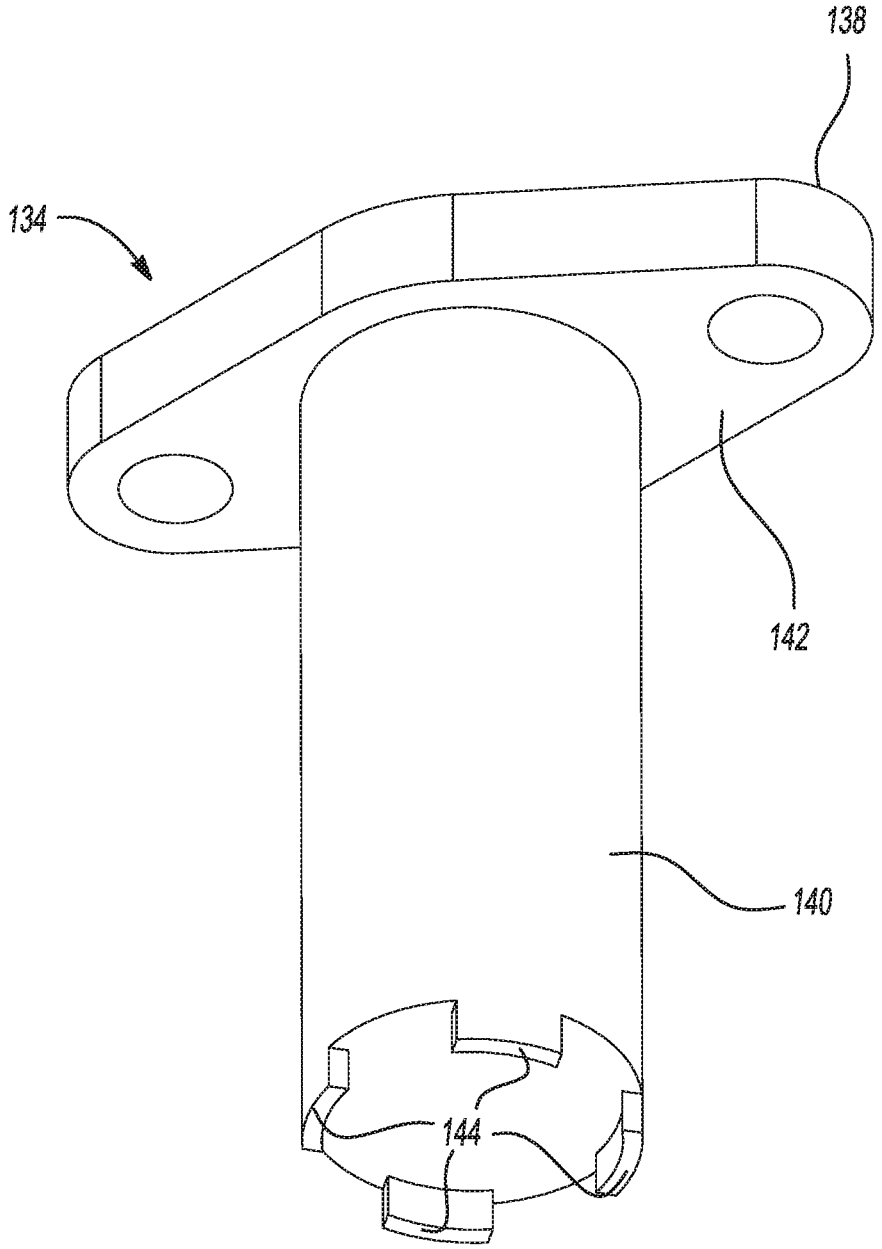
FIG. 15 is a perspective view of a retainer for the discharge valve.

With reference to FIGS. 14A, 14B, and 15, an alternative embodiment including a valve plate 130, a discharge valve 132 and a retainer 134 will now be described. Like the valve plate 36, the valve plate 130 is integrally formed with the cylinder head 42 and includes a valve seat 136 against which the discharge valve 40 can seat to seal off the discharge passage 52 from the corresponding cylinder 22. In this regard, the valve seat 136 may be referred to as a discharge valve seat. However, the geometry of the valve seat 136 is different than the geometry of the third valve seat 54 of the valve plate 36 to accommodate the discharge valves 132 and the retainers 134.

The discharge valve 132 may be a thin, annular reed valve that has a flat disk shape. Like the retainer 78, the retainer 134 includes a mounting flange 138, a cylindrical body 140 projecting axially from a bottom surface 142 of the mounting flange 138, and extensions 144 projecting axially from the cylindrical body 140. Like the extensions 92 on the retainer 78, the extensions 144 on the retainer 134 cooperate to define a pocket 146 therebetween in which the discharge valve 132 moves between its open and closed positions. However, in contrast to the extensions 92 on the retainer 78, the extensions 144 on the retainer 134 are thin, rounded tabs.

To accommodate the discharge valves 132 and the retainers 134, the valve seat 136 includes a radially inner wall 148 extending around the discharge passage 52 and configured to support the discharge valve 132. The valve seat 136 defines an annular pocket 150 disposed about the radially inner wall 148. The extensions 144 on the retainer 134 extend into the annular pocket 150 and surround the discharge valve 132 to capture the discharge valve 132 therebetween.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cylinder head assembly for a compressor, comprising:

a valve plate configured to mount to a mounting surface of the compressor, the valve plate defining a suction chamber, a first suction passage providing fluid communication between the suction chamber and a first cylinder of the compressor, a first suction valve seat through which the first suction passage extends, a first discharge passage extending through the valve plate, and a first discharge valve seat through which the first discharge passage extends;

a first suction valve movable between an open position, in which the first suction valve is spaced apart from the first suction valve seat and thereby allows fluid flow through the first suction passage, and a closed position, in which the first suction valve sealingly contacts the first suction valve seat and thereby prevents fluid flow through the first suction passage;

a first discharge valve movable between an open position, in which the first discharge valve is spaced apart from the first discharge valve seat and thereby allows fluid flow through the first discharge passage, and a closed position, in which the first discharge valve sealingly contacts the first discharge valve seat and thereby prevents fluid flow through the first discharge passage;

a cylinder head defining a discharge chamber that is in selective fluid communication with the first cylinder via the first discharge passage, the cylinder head and the valve plate being formed together as a unitary body, the valve plate forming a bottom wall of the cylinder head, the cylinder head further including a sidewall projecting from the valve plate and a top wall disposed opposite of the valve plate and at least partially covering the valve plate, the top wall defining a first mounting hole that is concentrically aligned with the first discharge passage, wherein the bottom wall, the sidewall, and the top wall cooperate to define the discharge chamber, and the discharge chamber is disposed directly between the top wall and the bottom wall; and a first retainer including a first mounting flange configured to be mounted to an outer top surface of the cylinder head, the first retainer extending through the first mounting hole toward the first discharge valve seat to retain the first discharge valve in a vicinity of the first discharge valve seat.

2. The cylinder head assembly of claim 1, wherein the cylinder head includes a support post extending from the top wall of the cylinder head to the valve plate.

3. The cylinder head assembly of claim 1, further comprising a biasing member biasing the first discharge valve against the first discharge valve seat.

4. The cylinder head assembly of claim 3, wherein the first discharge valve seat has a conical surface and the first discharge valve has a beveled edge configured to seat against the conical surface.

5. The cylinder head assembly of claim 3, wherein the first retainer further includes a cylindrical body projecting from the first mounting flange and a plurality of extensions projecting from the cylindrical body and defining a retaining pocket therebetween for retaining and directly contacting the first discharge valve.

6. The cylinder head assembly of claim 5, wherein the first discharge valve seat includes a radially inner wall extending around the first discharge passage and configured to support the first discharge valve, the first discharge valve seat defining an annular pocket disposed about the radially inner wall, the extensions on the first retainer extending into the annular pocket and surrounding the first discharge valve to capture the first discharge valve therebetween.

7. The cylinder head assembly of claim 6, wherein the top wall of the cylinder head defines blind holes adjacent to the first mounting hole, and the first mounting flange of the first retainer defines holes extending therethrough that are concentrically alignable with corresponding ones of the blind holes.

8. The cylinder head assembly of claim 7, further comprising a plurality of retainer bolts configured to be inserted through the holes in the first mounting flange of the first retainer and into the corresponding blind holes in the top wall of the cylinder head to secure the first retainer to the cylinder head.

9. The cylinder head assembly of claim 7, wherein the cylinder head includes a plurality of bosses extending from an underside of the top wall and concentrically aligned with corresponding ones of the blind holes, wherein the blind holes extend at least partially through the corresponding bosses.

10. The cylinder head assembly of claim 1, wherein the cylinder head includes a plurality of ribs that project from an underside surface of the top wall and from an interior surface of the sidewall.

11. The cylinder head assembly of claim 10, wherein the cylinder head defines a plurality of holes disposed about the perimeter of the cylinder head and extending through the top wall and the sidewall, the plurality of ribs including an annular rib that extend around the first mounting hole and a plurality of linear ribs that extend from the first mounting hole toward the plurality of holes.

12. The cylinder head assembly of claim 1, wherein the first suction passage is coaxial with the first discharge passage.

13. The cylinder head assembly of claim 1, wherein the valve plate defines a discharge port through which fluid flows to exit the discharge chamber.

14. The cylinder head assembly of claim 1, wherein:

the valve plate defines a second suction passage providing fluid communication between the suction chamber and a second cylinder of the compressor, a second suction valve seat through which the second suction passage extends, a second discharge passage extending through the valve plate, and a second discharge valve seat through which the second discharge passage extends;

the discharge chamber of the cylinder head is in selective fluid communication with the second cylinder via the second discharge passage;

the top wall of the cylinder head defines a second mounting hole that is concentrically aligned with the second discharge passage; and the cylinder head assembly further comprises:

a second suction valve movable between an open position, in which the second suction valve is spaced apart from the second suction valve seat and thereby allows fluid flow through the second suction passage, and a closed position, in which the second suction valve sealingly contacts the second suction valve seat and thereby prevents fluid flow through the second suction passage;

a second discharge valve movable between an open position, in which the second discharge valve is spaced apart from the second discharge valve seat and thereby allows fluid flow through the second discharge passage, and a closed position, in which the second discharge valve sealingly contacts the second discharge valve seat and thereby prevents fluid flow through the second discharge passage; and a second retainer extending through the second mounting hole toward the second discharge valve seat to retain the second discharge valve in a vicinity of the second discharge valve seat.

15. The cylinder head assembly of claim 14, wherein:

the first retainer further includes a first cylindrical body projecting from the first mounting flange and configured to extend through the first mounting hole in the top wall of the cylinder head and a first plurality of extensions projecting from the first cylindrical body and defining a first pocket therebetween for retaining and directly contacting the first discharge valve; and the second retainer includes a second mounting flange configured to be mounted to the outer top surface of the cylinder head, a second cylindrical body projecting from the second mounting flange and configured to extend through the second mounting hole in the top wall of the cylinder head, and a second plurality of extensions projecting from the second cylindrical body and defining a second pocket therebetween for retaining and directly contacting the second discharge valve.

16. A discharge valve assembly for a compressor, comprising:

a discharge valve movable between a closed position, in which the discharge valve sealingly contacts a discharge valve seat defined by a valve plate to prevent fluid communication between a cylinder of the compressor and a discharge chamber within a cylinder head that covers the valve plate, and an open position, in which the discharge valve is spaced apart from the discharge valve seat and thereby allows fluid communication between the cylinder and the discharge chamber;

a biasing member configured to bias the discharge valve against the discharge valve seat; and a retainer configured to extend through a top wall of the cylinder head and toward the discharge valve seat to retain the discharge valve in a vicinity of the discharge valve seat, the retainer including a mounting flange configured to be mounted to an outer top surface of the cylinder head, a cylindrical body projecting from the mounting flange and configured to extend through the top wall of the cylinder head, and a plurality of extensions projecting from the cylindrical body for containing and directly contacting the discharge valve, and for retaining the discharge valve in the vicinity of the discharge valve seat.

17. The discharge valve assembly of claim 16, wherein at least a portion of a bottom surface of the mounting flange is roughened to provide a seal between the bottom surface of the mounting flange and the outer top surface of the cylinder head.

18. The discharge valve assembly of claim 16, wherein the discharge valve has a discus puck shape.

19. The discharge valve assembly of claim 16, wherein the discharge valve has a flat disk shape.

20. A compressor, comprising:

a housing defining a cylinder and having a mounting surface surrounding an opening of the cylinder;

a piston disposed within the housing, movable within the cylinder, and defining a compression chamber within the cylinder;

a valve plate configured to mount to the mounting surface of the compressor, the valve plate defining a suction chamber, a suction passage providing fluid communication between the suction chamber and the compression chamber, a suction valve seat through which the suction passage extends, a discharge passage extending through the valve plate, and a discharge valve seat;

a suction valve movable between an open position, in which the suction valve is spaced apart from the suction valve seat and thereby allows fluid flow through the suction passage, and a closed position, in which the suction valve sealingly contacts the suction valve seat and thereby prevents fluid flow through the suction passage;

a discharge valve movable between an open position, in which the discharge valve is spaced apart from the discharge valve seat and thereby allows fluid flow through the discharge passage, and a closed position, in which the discharge valve sealingly contacts the discharge valve seat and thereby prevents fluid flow through the discharge passage;

a cylinder head defining a discharge chamber that is in selective fluid communication with the compression chamber via the discharge passage, the cylinder head and the valve plate being formed together as a unitary body, the valve plate forming a bottom wall of the cylinder head, the cylinder head further including a sidewall projecting from the valve plate and a top wall disposed opposite of the valve plate and at least partially covering the valve plate, the top wall defining a mounting hole that is concentrically aligned with the discharge passage, wherein the bottom wall, the sidewall, and the top wall cooperate to define the discharge chamber, and the discharge chamber is disposed directly between the top wall and the bottom wall; and a retainer extending through the mounting hole toward the discharge valve seat to retain the discharge valve in a vicinity of the discharge valve seat, wherein the suction chamber is disposed between the bottom wall of the cylinder head and the mounting surface of the compressor.

21. The compressor of claim 20, further comprising a biasing member biasing the discharge valve against the discharge valve seat.

22. The compressor of claim 21, wherein the discharge valve seats against the discharge valve seat when a force acting on the discharge valve due to pressure in the compression chamber is less than a biasing force applied by the biasing member to bias the discharge valve against the discharge valve seat.

23. The compressor of claim 20, wherein the retainer includes a mounting flange configured to be mounted to an outer top surface of the cylinder head, a cylindrical body projecting from the mounting flange and configured to extend through the mounting hole in the top wall of the cylinder head, and a plurality of extensions projecting from the cylindrical body and defining a pocket therebetween for retaining and directly contacting the discharge valve.

* * * * *